United States Patent [19]

Ban et al.

[11] 4,220,454

[45] Sep. 2, 1980

[54] PROCESS FOR GASIFYING PELLETIZED CARBONACEOUS FUELS

[75] Inventors: Thomas E. Ban, South Euclid; John C. Sheppard, Cleveland; William H. Marlowe, Euclid, all of Ohio

[73] Assignee: McDowell-Wellman Company, Cleveland, Ohio

[21] Appl. No.: 974,611

[22] Filed: Dec. 29, 1978

[51] Int. Cl.[2] ..... C10J 3/00

[52] U.S. Cl. ..... 48/202; 48/203; 48/204; 48/206; 48/210; 252/373

[58] Field of Search ..... 48/202, 203, 204, 206, 48/210; 201/6, 22, 32, 38, 40, 44; 252/373

[56] References Cited

U.S. PATENT DOCUMENTS

| | | | |
|---|---|---|---|
| 1,918,162 | 7/1933 | Willson | 201/32 |
| 3,226,212 | 12/1965 | Ban | 48/206 |
| 3,441,480 | 4/1969 | Ban | 201/32 |
| 3,987,192 | 1/1974 | Ban | 48/203 |
| 4,111,755 | 9/1978 | Ban et al. | 201/6 |

FOREIGN PATENT DOCUMENTS

| | | | |
|---|---|---|---|
| 376072 | 7/1932 | United Kingdom | 201/22 |

*Primary Examiner*—Peter F. Kratz

*Attorney, Agent, or Firm*—Pearne, Gordon & Sessions

[57] ABSTRACT

A process is disclosed for gasifying pelletized coal to produce a low Btu gas containing large amounts of hydrogen and carbon monoxide. Advantageously, the process is carried out on a circular traveling grate machine on a continuous basis. A horizontally moving, quiescent, gas-permeable bed of coal is formed by depositing at least one layer of a sized recycle charge of coal and at least one layer of fresh coal. To initiate an oxidizing reaction zone, the surface of one of the layers is ignited and the zone travels as a wave downwardly into the layer and upwardly into any superposed layer. Air and steam or air and carbon dioxide are either updrafted or downdrafted through the bed to control combustion. The coal is reduced in zones ahead of the advancing zone or zones of oxidation, and the reactions are terminated before the oxidation zone reaches both outermost surfaces of the bed to minimize the formation of carbon dioxide. Unreacted coal is separated from fine ash and is used as the recycle feed.

10 Claims, 4 Drawing Figures

PROCESS FOR GASIFYING PELLETIZED CARBONACEOUS FUELS

BACKGROUND OF THE INVENTION

Production of low Btu gas or producer gas from air-steam reactions with carbonaceous fuel has been practiced for a number of years. Prominent methods are identified as "fixed bed gas producer systems" typified by the Wellman-Galusha gas producer wherein sized coal is allowed to descend in a shaft furnace countercurrent to an air-steam blast and the well-known sequential reactions take place with the coal in various zones.

The first zone is the lowermost zone where oxidation reactions take place wherein carbon reacts with air and provides heat for supporting subsequent reactions. The basic reactions occurring in the oxidation zone are:

$$C+O_2 \rightarrow CO_2 \text{ and } 2C+O_2 \rightarrow 2CO$$

In an upper zone, reducing reactions occur and carbon reacts with the hot products of combustion and moisture from the lower oxidizing zone, as follows:

$$CO_2+C \rightarrow 2CO \text{ and } H_2O+C \rightarrow CO+H_2.$$

The uppermost zone is a zone of drying and pyrolysis, wherein moisture is removed and carbonaceous matter is decomposed by high temperature pyrolysis. This is typified by the following reactions:

Large molecule hydrocarbonaceous matter + heat → carbon + condensable acids, tars, and hydrocarbons + gaseous hydrocarbons and noncondensable gases such as $H_2$, $H_2O$, CO, $CO_2$, and $NH_3$.

Within a continuous shaft column, the draft enters at the bottom through grating as air and water vapor and becomes heated by the hot ash in the lowermost layers. As the gases ascend, the respective oxidizing, reducing, and pyrolyzing reactions take place to provide a mixed producer gas of the following general composition:

CO—25-30%
$H_2$—12-16%
$CH_4$—2-4%
$CO_2$—3-6%
$O_2$—0-1%
$N_2$—45-55%

These gases are frequently mixed with unreacted water vapor and condensibles from pyrolysis, such as tars and light oils.

High fixed carbon coal, such as anthracite, or pyrolyzed coal, such as coke or charcoal, can be used instead of coal so that products of pyrolysis are minimal. Also, oxygen and steam can be used as a draft blend, and steam can be replaced in part or total by $CO_2$.

The main function of introducing steam or $CO_2$ with the oxygen or air blast is to provide a thermal diluent and an endothermal-gasification reaction, which minimizes reaction temperature and prevents clinkering of the ash constituents. This enables uniform draft solid reactions and flow continuity to be maintained within the shaft furnace. The endothermal reactions are:

$$H_2O+C \rightarrow CO+H_2 \text{ and}$$

$$CO_2+H_2 \rightarrow H_2O+CO.$$

These reactions and the inert nature of $H_2O$ and $CO_2$ during oxidation absorb heat and lower the temperature of the burden and ash to prevent excessive clinkering.

Control of the operation is thereby afforded by control of steam or $CO_2$ input ratios with the air or oxygen blast.

Columns of charge ranging from about 1 foot to about 4 feet deep are required to enable the distinct oxidizing and subsequent reducing reactions to take place.

A major disadvantage of column reactors is the fact that the coal is required to progress from the top of the column to the bottom to be gasified and to be eventually dumped as ash. The coal particles are therefore moving relative to the apparatus and relative to each other, creating large amounts of fly ash and soot, which must be washed or otherwise removed from the producer gas.

SUMMARY OF THE INVENTION

This invention relates to processes for producing low Btu gas from coke pellets by employing a traveling grate process and, most desirably, a circular traveling grate process. The traveling grate processes for retorting and carbonizing fuels have been described in a number of U.S. Patents, i.e., Nos. 3,325,395; 3,787,192; 3,470,275; and 4,039,427. In many of these patents, the processes have involved the use of a liquid sealed circular traveling grate described in U.S. Pat. Nos. 3,302,936 and 4,013,517. This type of traveling grate enables pyrolysis and carbonizing reactions to take place without infiltration of atmospheric air, thereby enabling safety and efficiency to be achieved.

Traveling grate processes are adequately carried out with thin beds of fine nodulized solids, thin beds of green pellets, discrete, close-sized compacts, thick beds of coarse solids or thick beds of recycled and indurated solids, such as hardened pellets.

Gasification of carbonaceous matter by a traveling grate process favors utilization of a thick or deep bed from about 2 feet deep to 4 feet deep. A bed of pellets is made up on the traveling grate of a sintering machine and the charge may comprise recycled, unspent, unreacted, durable structures, such as carbonized pellets and green pellets and/or pelletized, pyrolized pellets as set forth in copending application Ser. No. 763,226, filed Nov. 27, 1977, now U.S. Pat. No. 4,111,755. These materials are layered onto the traveling grate in a number of different multilayer arrangements. At the beginning of the process, the surface of one of the layers is ignited to initiate an oxidizing reaction zone. The ignited layer may be immediately covered with a further layer of pellets. In either event, the charge is moved to a gasification zone, where it is updrafted or downdrafted with a mixture of air and steam or air and $CO_2$.

Ignition causes an oxidizing zone to progress through the bed toward at least one of the surfaces of the bed. The oxidizing zone advances on a carbonizing or reducing zone as the process continues. The maintenance of a deep bed for continuously sustaining gasification by the traveling grate process requires the termination of gasification before the oxidizing zone materially reduces the size of the reducing zone. Desirably, in a 4-foot bed, the size of the reducing zone should not be less than about 1½ feet, and the $CO_2$ issuing from the bed should not rise substantially over about 10%. Termination of the reaction at this point causes a substantial portion of the bed to be unreacted. For this reason, the unreacted portions are removed from the reacted portion of the fuel (ash) and the unreacted portions are recycled to the traveling grate cycle for (1) maintenance of a deep bed and (2) utilization of the fuel for maximum efficiency. A method for controlling the separation process may be done in one of two ways, as follows:

(1) excessive bed temperatures may be utilized to enable the ash to vitrify and clinker, thereby allowing it to enlarge and be separated as oversize by a crushing sizing operation from the nugget sized, unreacted pelletized charge; and (2) moderate bed temperatures may be utilized to enable the ash to be weakly structured and powdery, thereby allowing the ash to be separated by an attrition and sizing operation from the nugget-sized, unreacted, pelletized charge.

Procedure (1) set forth above is accomplished by control of the exothermal reactions, as accomplished largely by using low steam or $CO_2$-to-air ratios and high draft rates. Procedure (2) may be accomplished by a similar control technique by using high steam or $CO_2$-to-air ratios and low draft rates. When sulfur fixation reactions are desired, such as those reactions set forth in U.S. Ser. No. 763,226, the procedure set forth in paragraph (2) above is favored, since it prevents decomposition of the sulfated components within the ash. According to that application, a pelletized coal is produced which is a calcined, hardened, carbonized, particulate sulfur-containing coal and a basic material with a large percentage of sulfur being present in the form of a sulfide of the basic material. The pelletized material is substantially free of hydrocarbonaceous volatile matter and graphite. The pellet fuel is produced by providing an intimate mixture of coherent particles of about −65 mesh, which enables sulfur fixation reactions to take place and to fix the sulfur by sulfatization to the ash constituents of the coal upon use of the pellets under oxidizing conditions.

An important aspect of the present invention is the fact that the pellets are gasified in a quiescent state to avoid entrainment of fly ash as occurs in stack-type gasifiers. A further important aspect of the present invention is that undesirable $CO_2$ production is minimized, while unreacted pellets are recycled back to the traveling grate feed for maximum fuel economy.

DETAILED DESCRIPTION OF THE INVENTION

Figure 1:
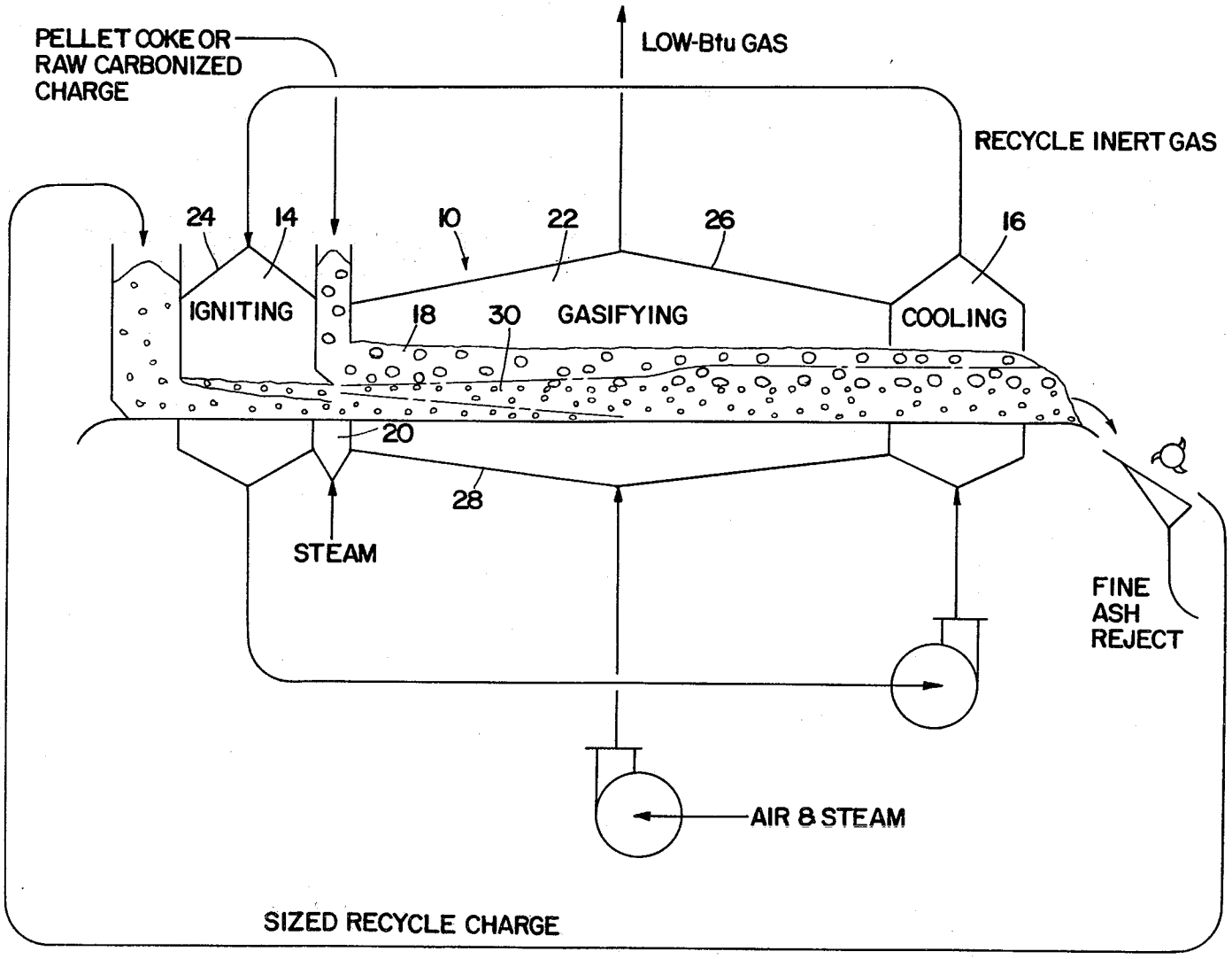
FIG. 1 is a diagrammatic and schematic representation of a development of a circular traveling grate machine, showing an updraft arrangement using a charge such as pellet coke.

Referring now to FIG. 1, there is illustrated a circular traveling grate machine 10 which is initially charged with recycled pellets which have had the ash removed by a screening operation. This charge is initially heated to incandescence in an igniting zone 14, using a recirculating and inert draft that becomes preheated in a cooling hood 16. Immediately thereafter, a fresh top layer, comprising a raw carbonized charge of pellet coke 18, is applied upon the lower incandescent layer. An updraft steam seal 20 between the igniting zone and a gasifying zone 22 inhibits lateral flow of gases between an igniting hood 24 and a gasifying hood 26. As an air stream draft is forced in a lower windbox 28 through the charge and through the gasification zone, the aforementioned gasification reactions take place.

It may be noted that a hot combustion band or oxidation zone 30, delineated by phantom outline in FIG. 1, progresses downwardly into the sized recycle charge 12 and upwardly into the pellet coke or raw carbonized charge 18 despite the admission of an updraft airstream blast. Heat transfer of the combusted charge enables migration of the zone downward to meet the air for oxidation and directional flow of the hot products of combustion causes an updraft movement, thus enhancing capacity of the system. Ahead of the upwardly advancing hot combustion band there exist the reducing and pyrolizing reactions.

Gasification is terminated before the hot combustion band ascends excessively wherein the $CO_2$ and products of gasification become increasingly high. Approximately a 1½-foot depth of charge is mildly unreacted in the topmost layers when the charge advances to the cooling zone 16.

The cooling zone functions to cool the charge and recuperate the heat for the ignition cycle. Within a circular retort, the cooling zone is in close proximity to the ignition zone.

The cooled, gasified charge discharges from the traveling grate as weak, powdery, totally spent pellets, some unreacted coke pellets and some partially reacted coke pellets which contain a weak, powdery surface layer of ash on the pellets. The ash constituents from these pellets and the totally spent pellets are removed by mild attrition after discharging, as accomplished by a trommel or vibrating screen operation. Fine, powdery ash is rejected from the system and the unspent carbon pellets contained in the discharge are recycled as oversize material to the bottom layers.

A basic material such as sized limestone may be used within a layer of the charge. The limestone may be applied directly in the lower layers as interspersed, coarse limestone, or as an upper stratified layer of charge (a) for further fixation of the sulfur within the bed of the charge and (b) as a thermal diluent within the bed of charge for inhibiting excessive, high-temperature combustion reactions from clinkering the bed and decomposing the sulfur which is fixed in the ash constituents as sulfates. The following table provides data on procedures and results from a specific gasification operation. These data were obtained from gasifying coke pellets produced from the process according to U.S. Ser. No. 763,226 now U.S. Pat. No. 4,111,755, the subject matter of which is incorporated herein by reference. Similar results can be acquired from other sized carbonaceous charge materials; however, the composition of the gas and the extend of sulfur fixation will vary from those presented herein. The data of the table were acquired from a static bed system which simulated a sealed, circular traveling grate. The process was performed by charging a stationary, pot-type grate with 54-inch sidewalls connected through water seals with a hood and windbox arrangement. Initially a 4-inch layer of incandescent pellets was charged to the grates, simulating the ignition cycle, and this was followed by direct-charging of the coke pellets on top. an up- draft of steam-air blend was then induced through the quiescent bed for a predetermined period of time. Periodic records were made of draft, gas, pressure, flow, and temperature conditions, as illustrated by the data of the table. The results clearly demonstrate the practicability of making clean producer gas, while terminating the gasification cycle to allow a sizing system for rejecting ash and providing normal pellets for recycle operation.

TABLE 1

Technique for Gasifying Coke Pellets
By Circular Traveling Grate Process

| Charge Data | | | |
|---|---|---|---|
| Size analysis | | | $-\frac{3}{4}'' + \frac{1}{4}''$ pellet |
| Charge weight | wet wt. lbs. | dry wt. lbs. | depth |
| Ignition layer | 14 | 9.5 | 4" of 2000° pellets |
| Top layer | 180 | 122.5 | 50" cold pellets |
| TOTAL | 194 | 132.0 | 54" |

| Charge composition | (dry basis) | % |
|---|---|---|
| | FC | 49.00 |
| | VM | 13.18 |
| | Ash | 37.82 |
| | S | 3.12 |
| Moisture content | | 31.80% |

| Gasification Technique | |
|---|---|
| Bed depth | 54 inches |
| Blast condition (air) | 159° F. saturated |
| Blast rate (air) | 25 SCFM |

| | Temperatures (°F.) | | | | |
|---|---|---|---|---|---|
| Periodic Data: | Grate +3" | Grate +12" | Grate +24" | Grate +34" | Hood |
| Elapsed Time - 1 min. | 180 | 140 | 140 | 125 | 170 |
| 30 min. | 2070 | 1625 | 150 | 150 | 170 |
| 60 min. | 2100 | 1600 | 1100 | 260 | 165 |
| 90 min. | 1240 | 1600 | 1420 | 1220 | 165 |
| 120 min. | 510 | 750 | 1200 | 1000 | 167 |
| 145 min. | 400 | 520 | 700 | 500 | 300 |

| Periodic Data: | Pressure in W.C. | Combustibles % | $CO_2$ Guide % |
|---|---|---|---|
| Elapsed Time-1 min. | 1.7 | +20 | 8.0 |
| 30 min. | 1.2 | +20 | 8.0 |
| 60 min. | 1.0 | +20 | 7.0 |
| 90 min. | 1.2 | +20 | 11.0 |
| 120 min. | 1.2 | +20 | 10.0 |
| 145 min. | 1.2 | +20 | 12.0 |

| Gasification Results | | |
|---|---|---|
| Gas Analysis: | $CO_2$ | — 5.3 |
| | CO | — 25.9 |
| | $H_2$ | — 9.8 |
| | $CH_4$ | — 0.05 |

| Quantity of Discharge: | |
|---|---|
| Layer 1 | 10.1 lbs. |
| Layer 2 | 22.7 lbs. |
| Layer 3 | 13.5 lbs. |
| Bottom layer | 28.5 lbs. |
| | 74.8 lbs |

| Composition of Discharge: | Ash | S |
|---|---|---|
| Layer 1 | 37.25% | 2.80% |
| Layer 2 | 39.00% | 3.20% |
| Layer 3 | 48.39% | 4.24% |
| Bottom layer | 89.53% | 6.50% |

| | |
|---|---|
| Quantity of Ash | 28.4 lbs. |
| Size analysis of ash | $-\frac{1}{8}$ inch |

| | Ash | Sulfur |
|---|---|---|
| Composition of ash | 96.24% | 7.08% |

TABLE 1-continued

Technique for Gasifying Coke Pellets
By Circular Traveling Grate Process

| | |
|---|---|
| Amount of discharge available for recycle | 46.4 lbs. |
| Composition of recycle: | 37.5% ash |

Figure 2:
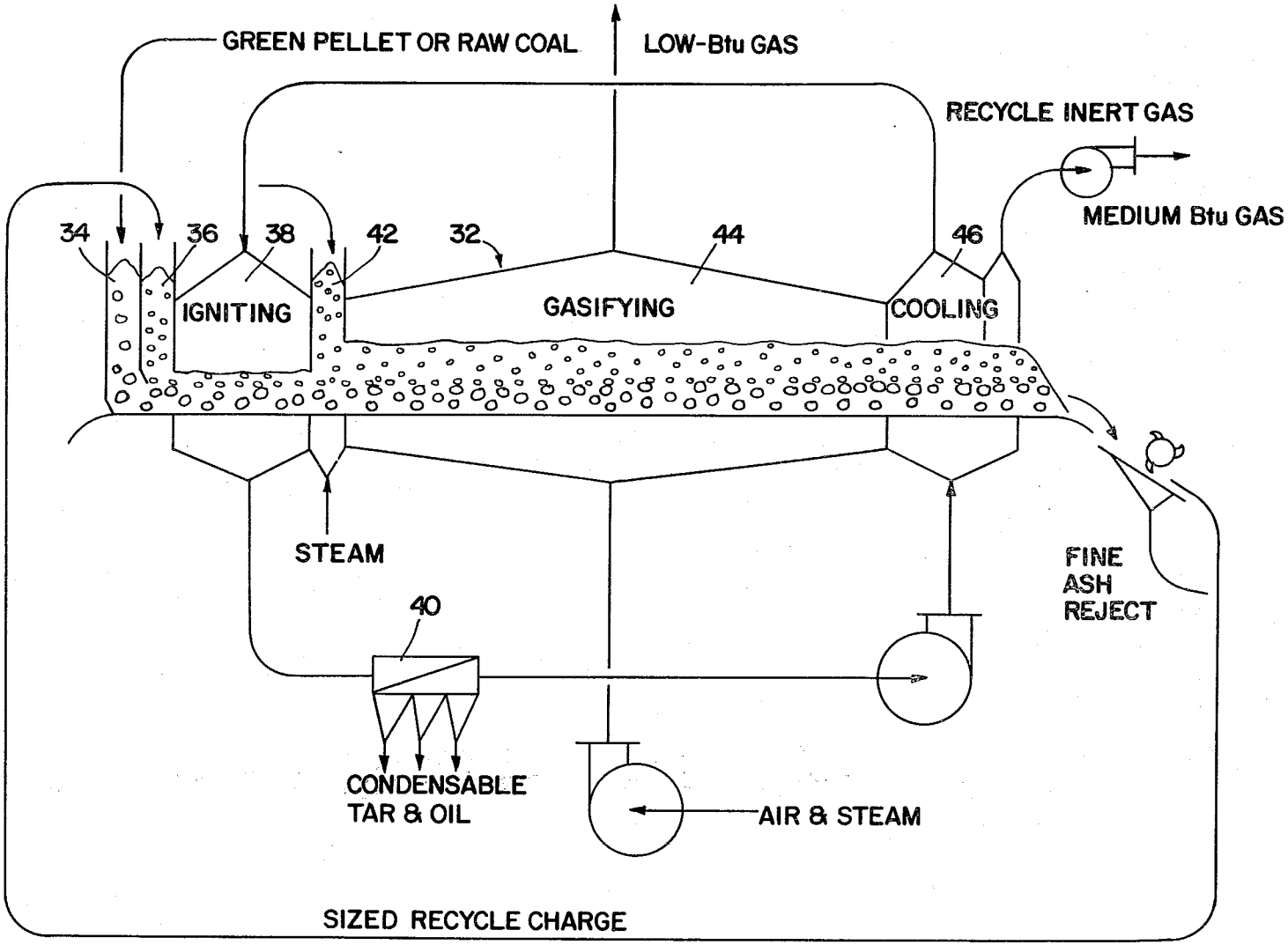
FIG. 2 is a diagrammatic and schematic illustration of a development of a circular traveling grate machine, illustrating an updraft arrangement using a charge comprised of green carbonaceous materials, such as coal or green pellets.

Turning now to FIG. 2, there is illustrated a circular traveling grate 32 for gasifying green pellet or raw coal 34 by a traveling grate process. Layered onto the green pellet or raw coal is a layer of sized recycle pellets 36. The recycled material is ignited in an ignition zone 38 and the initial ignition causes pyrolysis of the green pellet or raw coal 34 for removal of condensible hydrocarbonaceous matter. This matter is condensed at 40. The ignited material is then covered with a top layer of hardened recycle material 42 and the charge is conveyed by the traveling grate to a gasifying zone 44 where reactions proceed which are similar to those reactions described in conjunction with the embodiment of FIG. 1. Air and steam or $CO_2$ are updrafted through the bed and a low Btu gas is withdrawn from the gasifying zone. The gas drawn from the ignition zone is drawn upwardly through the bed at a cooling zone 46 to cool the bed and then is recycled to the ignition zone as an inert gas. Other gas is withdrawn as a medium Btu gas, as indicated.

Since, as was indicated in describing FIG. 1, not all of the pelletized material in the bed is reacted, the discharge contains some unreacted coke pellets and some partially reacted coke pellets which contain a weak, powdery surface layer of ash on the pellets. The ash constituents from these pellets and the totally spent pellets are removed by mild attrition after discharging, as accomplished by a trommel or vibrating screening operation. Fine, powdery ash is rejected from the system and the unspent carbon pellets contained in the discharge are recycled as oversize material to become the separate charges 36 and 42.

Figure 3:
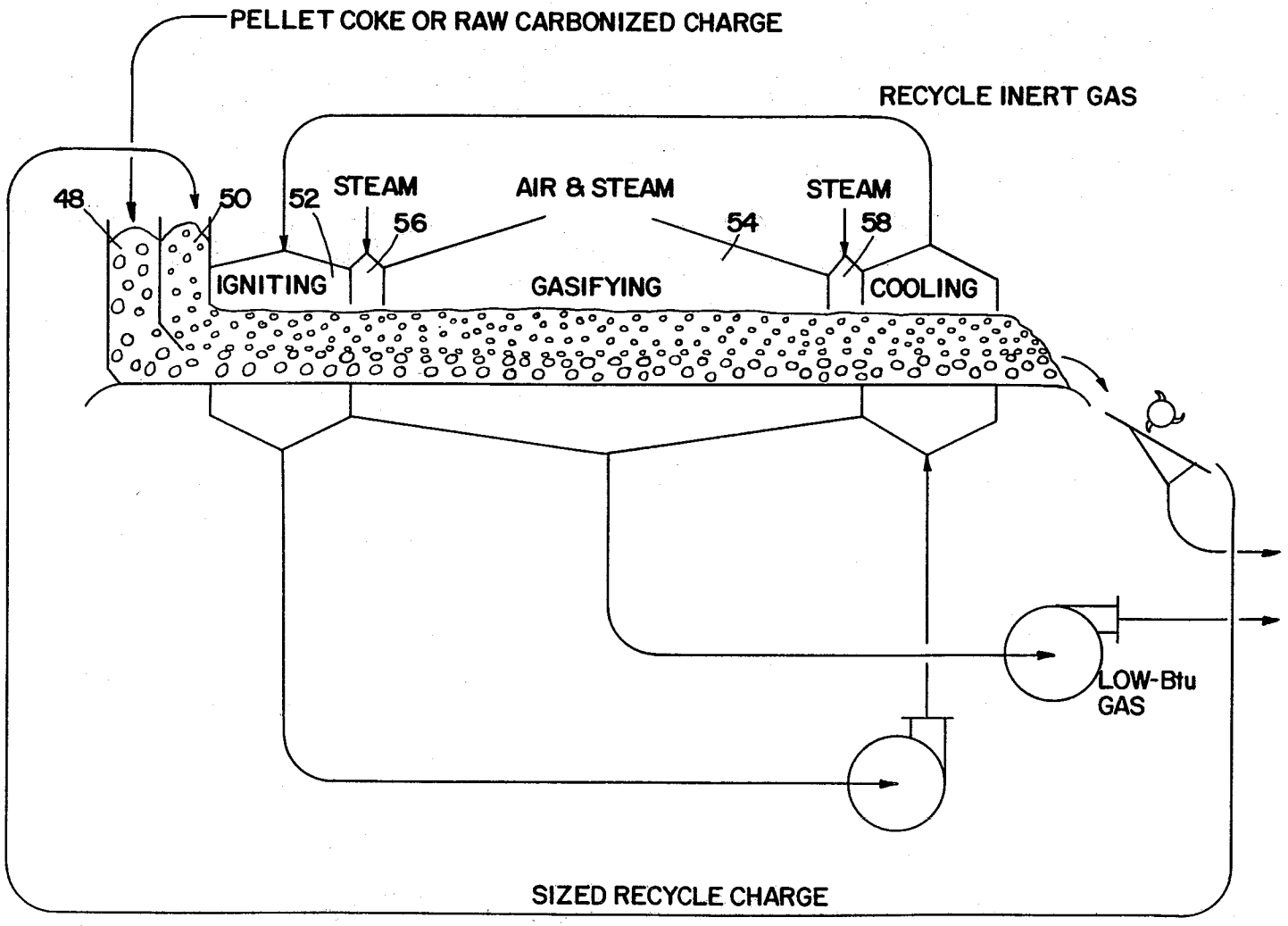
FIG. 3 is a diagrammatic and schematic illustration of a development of a circular traveling grate machine, illustrating a downdraft arrangement which uses a charge such as pellet coke.

Referring now to FIG. 3, there is illustrated a process for gasifying coke products by a downdraft operation. Here it may be noted that a deep bed of raw charge 48 is applied directly on the grates and sized, unreacted recycle material 50 serves as a top layer. The layering operations are followed by ignition from preheating the bed surface with hot, inert gas from the cooling zone, followed by oxidation of the surface layers with a downdraft of steam and air of $CO_2$ in a gasifying zone 54. Short steam or inert gas zones 56 and 58 are located between the ignition and gasifying and the gasifying and cooling zones to eliminate air infiltration to the inert gas zones. The downdraft operation causes the topmost layers to oxidize and gasify under controlled combustion conditions, wherein the pellets are converted to a friable ash product. This is readily removed from the unreacted pellets by a screening operation.

Figure 4:
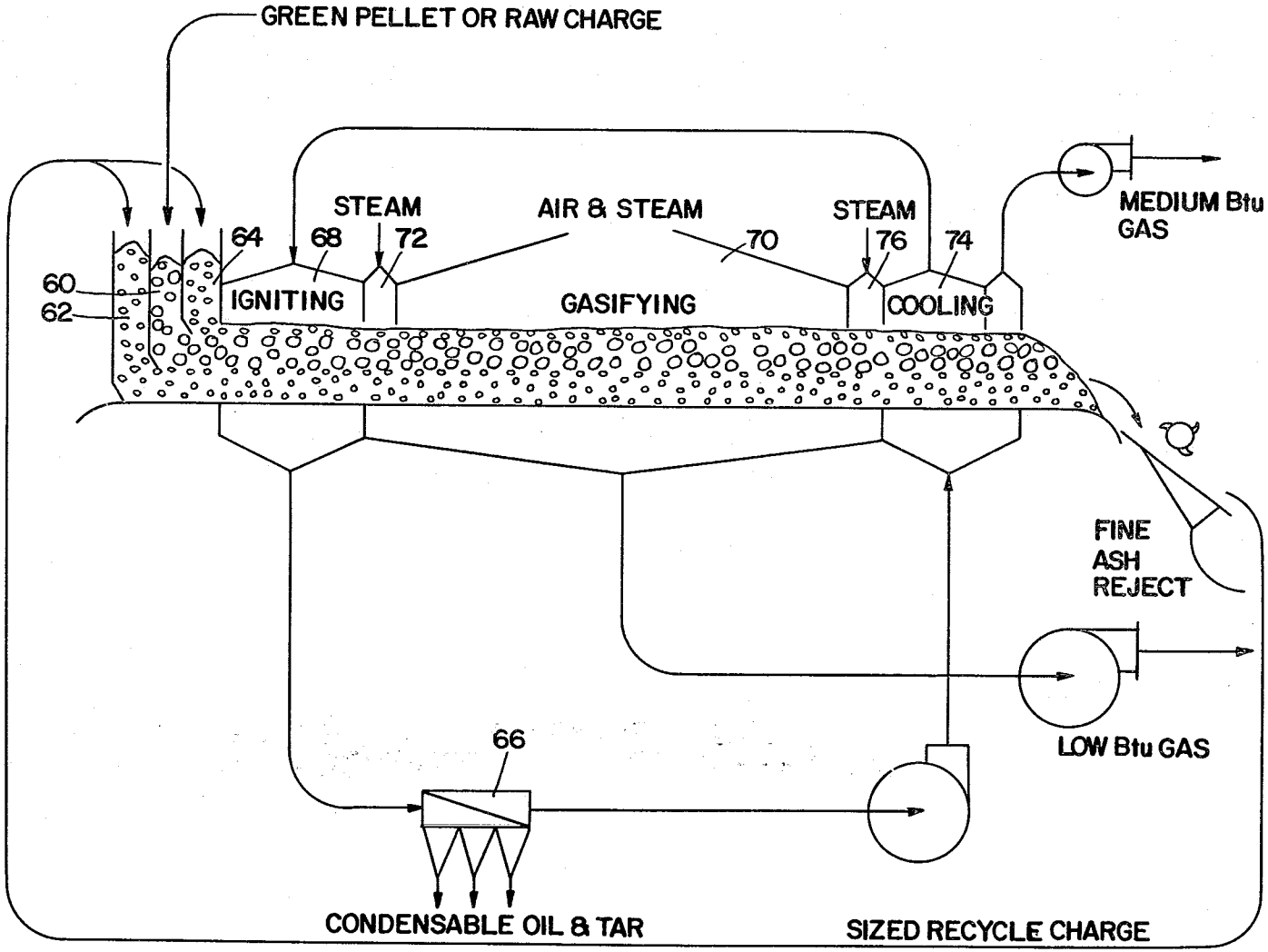
FIG. 4 illustrates a diagrammatic and schematic representation of a development of a circular traveling grate machine showing a downdraft arrangement which uses a green charge, such as coal or green pellets.

Turning now to FIG. 4, there is illustrated a downdraft operation which incorporates green pellets of coal or raw sized coal 60 on top of recycled coked pellets 62. A top layer of sized recycle material 64 is applied to the green pellets similar to that illustrated in FIG. 2. This top layer is used for sealing and minimizing green pellet degradation. A mist arrestor 66 is provided to remove condensible hydrocarbonaceous material which emits during the ignition cycle in the ignition zone 68. Air and steam are downdrafted through the burden in a gasifying zone 70 and the low Btu gas is withdrawn. The gasifying and ignition zones 68 and 70 are separated by a steam downdraft zone 72 and the gasifying zone is separated from a cooling zone 74 by a steam downdraft zone 76.

Although preferred embodiments of this invention are illustrated, it should be understood that various modifications and rearrangements of parts may be resorted to without departing from the scope of the invention disclosed and claimed herein.

What is claimed is:

1. A process for gasifying coal to produce a low Btu gas containing large amounts of hydrogen and carbon monoxide, comprising the steps of continuously forming a generally horizontally moving, quiescent gas-permeable bed comprising at least one layer of a sized recycle charge of unreacted coke and at least one layer of fresh coal, moving said bed horizontally, igniting the surface of one of said layers to initiate an oxidizing reaction zone which travels as a wave from said surface downwardly into one of said layers and as a wave upwardly into any superposed layer, moving air and an inert fluid vertically through the bed, reducing said coal and unreacted coke in a zone ahead of each advancing wave, terminating the oxidizing reaction before the reaction reaches at least one outermost surface of the bed to minimize the formation of carbon dioxide, wherein said oxidizing reaction is terminated when carbon dioxide emitted from the bed reaches about 10%, or said bed is about 4 feet deep and said oxidizing reaction is terminated when the reducing zone is about $1\frac{1}{2}$ feet deep, separating unreacted coke of a predetermined size from ash, and returning said unreacted coke to the bed as said recycle charge.

2. A process according to claim 1, wherein a basic material is added to the bed.

3. A process according to claim 1, wherein said inert fluid is steam.

4. A process according to claim 1, wherein said inert fluid is $CO_2$.

5. A process according to claim 1, wherein said fresh coal is pelletized coal.

6. A process according to claim 5, wherein said pelletized coal is a hardened carbonized sulfur-containing coal and a basic material with a large percentage of sulfur being present in the form of a sulfide of the basic material, said pelletized coal being substantially free of hydrocarbonaceous volatile matter, and graphite, and providing an intimate mixture of coherent particles of about -65 mesh in size, which thereby enables sulfur fixation reactions to take place and to fix the sulfur by sulfatization to the ash constituents of the coal upon use of the pellets under oxidizing conditions.

7. A process according to claim 1, wherein said recycle charge is layered on a horizontally moving hearth, is ignited, and is then covered by a layer of fresh coal.

8. A process according to claim 1, wherein fresh green pellet coal is layered on a horizontally moving hearth, wherein a first layer of recycle charge is placed on the green pellet layer, wherein said first recycle charge layer is ignited, and wherein a second layer of recycle charge is placed on the ignited first layer.

9. A process according to claim 1, wherein fresh pellet coal is layered on a horizontally moving hearth, wherein a layer of recycle charge is placed on said pellet coal, and wherein said recycle charge is ignited.

10. A process according to claim 1, wherein a first layer of recycle charge is placed on a horizontally moving hearth, wherein a layer of fresh green pellet coal is placed on the first recycle charge layer, wherein a second layer of recycle charge is placed on the green pellet layer, and wherein said second recycle charge layer is ignited.

* * * * *